US005669256A

United States Patent [19]

Chung

[11] Patent Number: 5,669,256

[45] Date of Patent: Sep. 23, 1997

[54] DOOR LOCK MECHANISM WITH A RELEASE BUTTON

[76] Inventor: Kuan-Chin Chung, No. 91, Chu Shan Road, Ho Hsin Tsun, Nei Pu Hsiang, Ping Tung Hsien, Taiwan

[21] Appl. No.: 739,894

[22] Filed: Oct. 30, 1996

[51] Int. Cl.[6] ..... E05B 65/00

[52] U.S. Cl. ..... 70/93; 292/264; 292/274; 292/341.17; 292/278

[58] Field of Search ..... 292/274, 278, 292/264, 341.17, 44 D; 70/93

[56] References Cited

U.S. PATENT DOCUMENTS

| | | | |
|---|---|---|---|
| 832,420 | 10/1906 | Rinaldy | 292/264 |
| 3,071,958 | 1/1963 | Russo | 292/264 |
| 3,897,966 | 8/1975 | Draughton, Sr. | 292/264 |
| 4,850,820 | 7/1989 | Baber | 292/341.17 |

*Primary Examiner*—Steven N. Meyers
*Assistant Examiner*—Stephen J. Pentlicki
*Attorney, Agent, or Firm*—Charles E. Baxley, Esq.

[57] ABSTRACT

A door lock mechanism includes a retainer housing mounted to a doorframe and a chain housing mounted to a door plate. The retainer housing includes a retaining slot defined in a lateral side thereof and a lock core mounted therein. A lock piece is pivotally received in the retaining slot and is releasably engaged with the retaining member. A chain is mounted in the chain housing and includes a fixed first end and a second end to which a slide bolt is securely attached. The slide bolt is releasably, slidably received in the retaining slot of the retainer housing. When in a locked position and when a release button is in its first position, the lock piece is stopped by the retaining member and the slide bolt is retained in the retaining slot and thus allows the door to be opened for a small gap. When in a locked position and when the release button is in its second position, the lock piece is disengaged from the lock piece and thus allows removal of the slide bolt from the retaining slot without operation of the lock core.

4 Claims, 9 Drawing Sheets

A—A

DOOR LOCK MECHANISM WITH A RELEASE BUTTON

BACKGROUND OF THE INVENTION

1. Field of the Invention

The present invention relates to a door lock mechanism with a release button which allows people inside a house to open the door of the house without the key.

2. Description of the Related Art

Applicant's U.S. patent application No. 08/533,258 discloses a door locking mechanism which allows the door to to be opened for a small gap only when the users go out such that unauthorized persons may think that somebody must be in the house and thus dare not break into the house. Nevertheless, people inside the house cannot go out without the key, which might be dangerous in some situations, e.g., the children are often left inside when the adults go out, and the children might be injured or even asphyxiate if fire occurs. The present invention is intended to provide an improved design to solve this problem.

SUMMARY OF THE INVENTION

A door lock mechanism in accordance with the present invention includes a retainer housing assembly and a chain housing assembly. The retainer housing assembly includes a retainer housing which is mounted to a doorframe and which includes a retaining slot defined in a lateral side thereof and a compartment defined therein for receiving a lock core therein. The lock core has a retaining member mounted to a lower end thereof, and a first elastic means is mounted around the retaining member.

A lock piece is pivotally received in the retaining slot and includes an arcuate operative surface. The lock piece further includes a first end releasably engaged with the retaining member and a second end. A second elastic means is provided for returning the lock piece to its initial position. A release button is mounted in the retainer housing and has a first end releasably engaged with the second end of the lock piece and a second end for manual operation so as to be moved between a first position which engages with the lock piece and a second position which disengages from the lock piece.

The chain housing assembly includes a chain housing which has a longitudinal compartment defined therein. A chain is received in the longitudinal compartment of the chain housing and includes a first end fixedly mounted to the chain housing and a second end which is stretchable beyond the chain housing. A third elastic means is mounted around the chain for returning the chain to its initial unstretched position. A slide bolt is securely mounted to the second end of the chain and releasably, slidably received in the retaining slot of the retainer housing.

When in a locked position and when the release button is in its first position, the lock piece is stopped by the retaining member and the slide bolt is retained in the retaining slot and allows the door to be opened for a small gap. When in a locked position and when the release button is in its second position, the lock piece is disengaged from the lock piece and thus allows removal of the slide bolt from the retaining slot without operation of the lock core.

Preferably, the second end of the release button is in the form of a push button.

In a preferred embodiment of the invention, the lock piece includes an upper stub and a lower stub respectively formed on upper and lower ends thereof. The second elastic means includes a first torsion spring mounted to the upper stub and a second torsion spring mounted to the lower stub, thereby allowing pivotal movements of the lock piece in the retaining slot.

Preferably, a washer may be mounted around the slide bolt to provide a distance between the retainer housing and the chain.

Other objects, advantages, and novel features of the invention will become more apparent from the following detailed description when taken in conjunction with the accompanying drawings.

DESCRIPTION OF THE PREFERRED EMBODIMENTS

Figure 1:
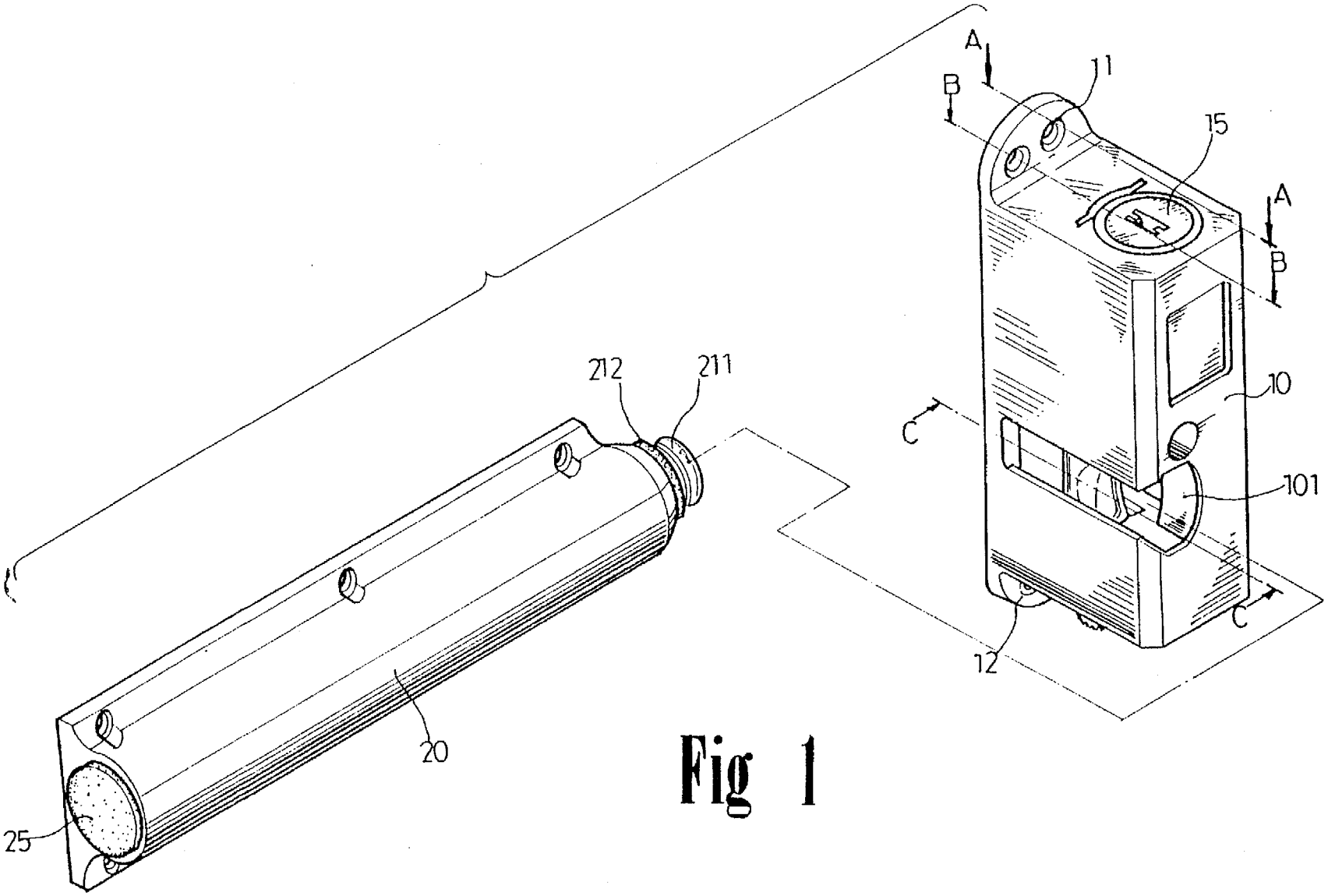
FIG. 1 is a perspective view of a door lock mechanism in accordance with the present invention.
Figure 2:
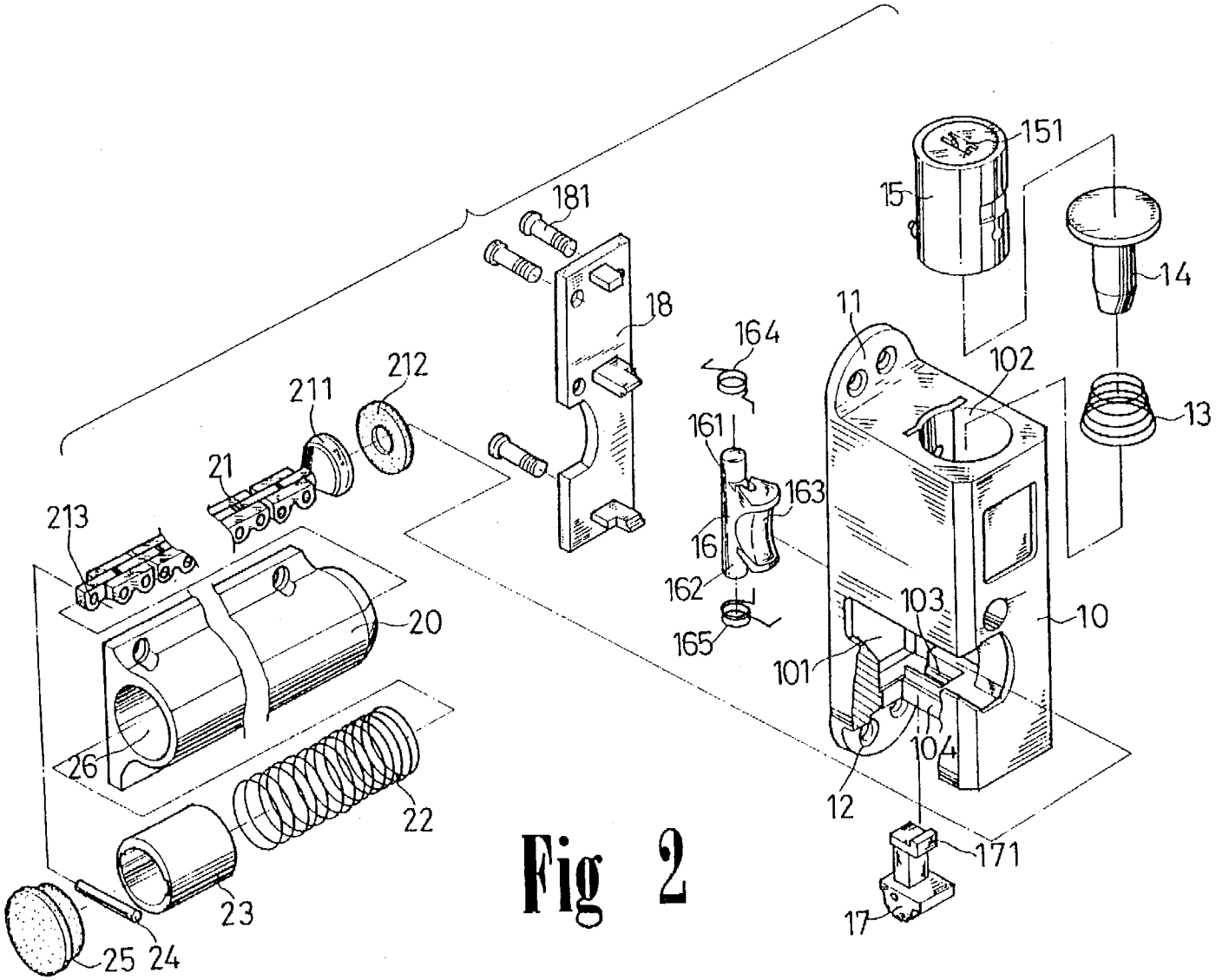
FIG. 2 is an exploded perspective view of the door lock mechanism in accordance with the present invention.
Figure 10:
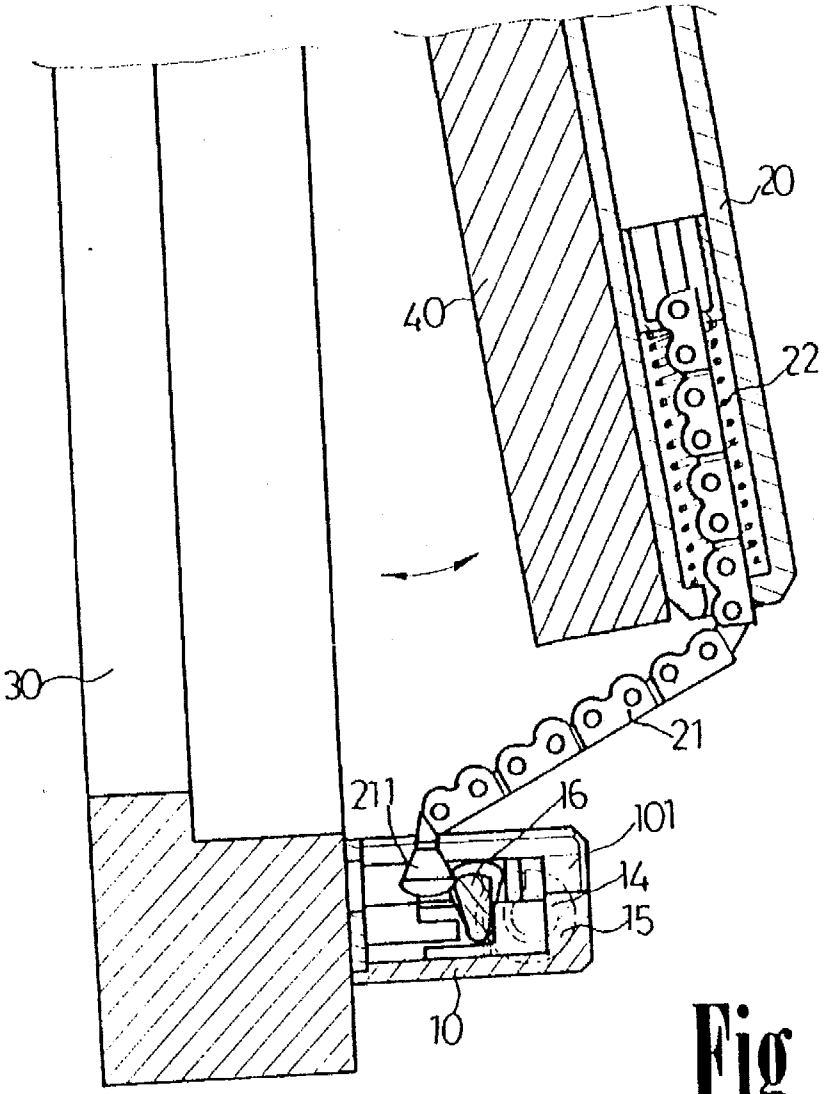
FIG. 10 is a cross-sectional view illustrating operation of the door lock mechanism.

Referring to the drawings and initially to FIGS. 1 and 2, a door lock mechanism in accordance with the present invention generally includes a retainer housing assembly mounted to a doorframe 30 (see FIG. 10) and a chain housing assembly mounted to a door plate 40 (see FIG. 10). The retainer housing assembly includes a retainer housing 10 having an upper lug 11 and a lower lug 12 respectively formed at upper and lower ends thereof. Both lugs 11 and 12 have screw holes (not labeled) for mounting the retainer housing 10 to the doorframe 30. The retainer housing 10 further includes a retaining slot 101 defined in a lateral side thereof. A bottom surface defining the retaining slot 101 includes two slide grooves 103 and 104 defined therein for respectively receiving a lock piece 16 and a release button 17.

Figure 3:
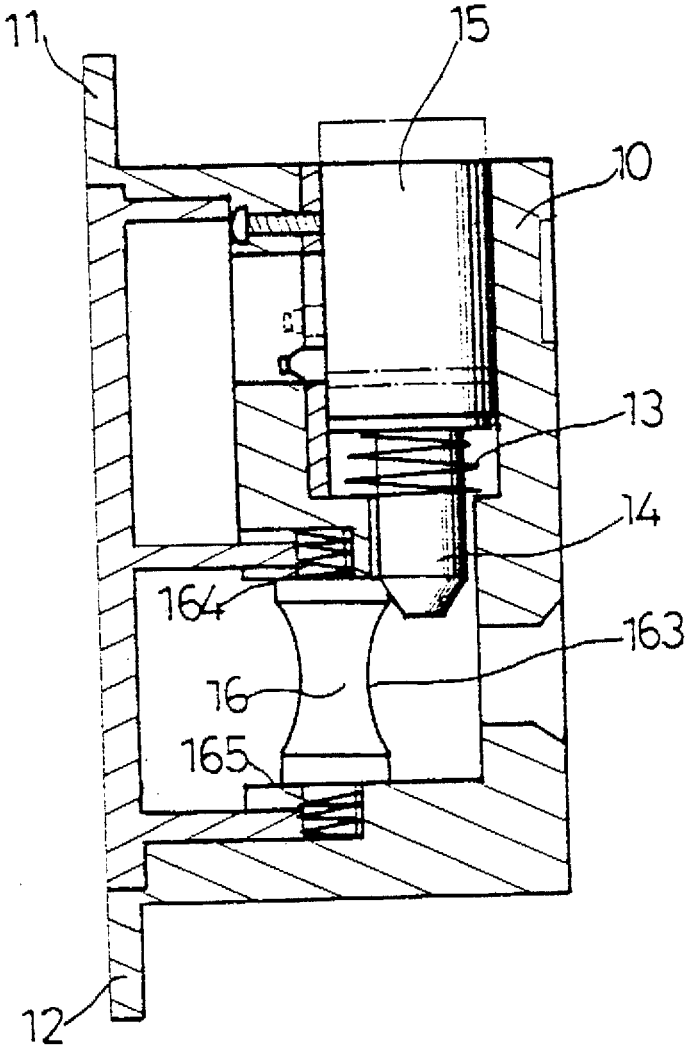
FIG. 3 is a cross-sectional view taken along line A—A in FIG. 1.
Figure 4:
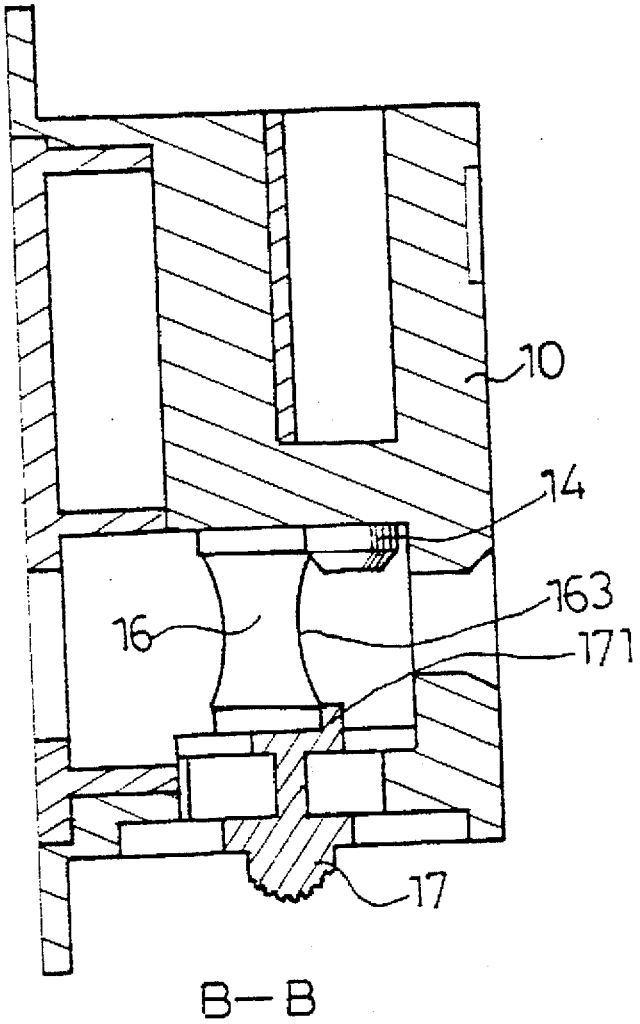
FIG. 4 is a cross-sectional view taken along line B—B in FIG. 1.

The lock piece 16 is pivotally received in the retaining slot 101. As shown in FIGS. 2 and 3, a first torsion spring 164 is mounted to an upper stub 161 formed on an upper end of the lock piece 16, and a second torsion spring 165 is mounted to a lower stub 162 formed on a lower end of the lock piece 16. The torsion springs 164 and 165 return the lock piece 16 to its initial position after a pivotal movement of the lock piece 16. In addition, the lock piece 16 includes an arcuate operative surface 163 which will be discussed later. As shown in FIG. 4, the release button 17 includes a first end 171 which is releasably engaged with the lower end of the lock piece 16, which will be discussed later.

Figure 5:
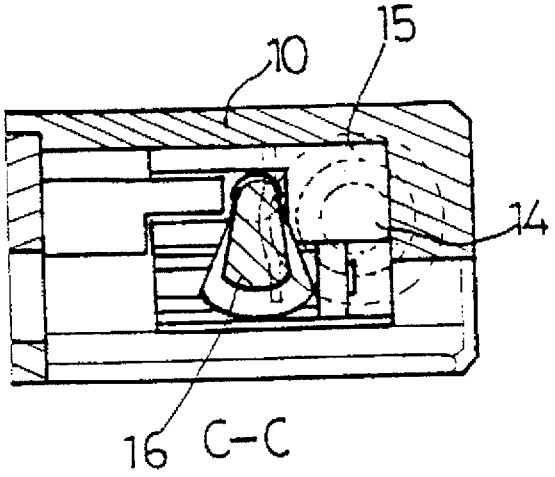
FIG. 5 is a cross-sectional view taken along line C—C in FIG. 1.

Referring to FIGS. 1 to 3, the retainer housing 10 further includes a compartment 102 defined in an upper portion thereof for receiving a lock core 15 therein. The lock core 15 includes a keyway 151 in an upper end thereof and a retaining member 14 mounted to a lower end thereof for engaging with the upper end of the lock piece 16, and a compression spring 13 is mounted around the retaining member 14. A cover plate 18 is mounted to a rear side of the retainer housing 10 by bolts 181. FIG. 5 illustrates a relative position between the lock piece 16 and the lock core 15.

Referring to FIGS. 1, 2, and 10, the chain housing assembly includes a chain housing 20 having a longitudinal compartment 26 defined therein for receiving a chain 21 therein. A first end of the chain 21 is fixedly mounted to the chain housing 20 by means of extending a pin 24 through a hole 213 defined in the first end of the chain 21 wherein two ends of the pin 24 are fixedly received in two aligned recesses (not labeled) of a sleeve 23 which, in turn, is securely received in the compartment 26. In addition, a cap 25 is mounted to a first end of the compartment 26 to enclose the elements.

An extension spring 22 is mounted around the chain 21 for returning the chain 21 to its initial unstretched position. A slide bolt 211 is securely mounted to a second end of the chain 21 and can be releasably, slidably received in the retaining slot 101. In addition, a washer 212 is mounted around the slide bolt 211 to assure that there is a distance between the retainer housing 10 and the chain 21.

Figure 6:
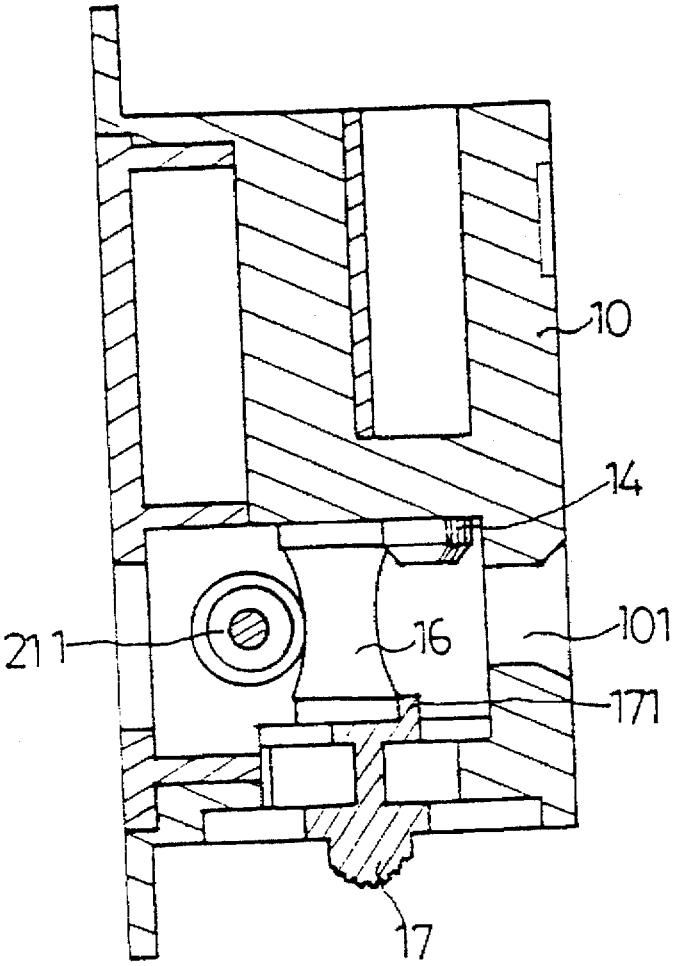
FIG. 6 is a cross-sectional view similar to FIG. 4, in which the door lock mechanism is in a locked status.
Figure 7:
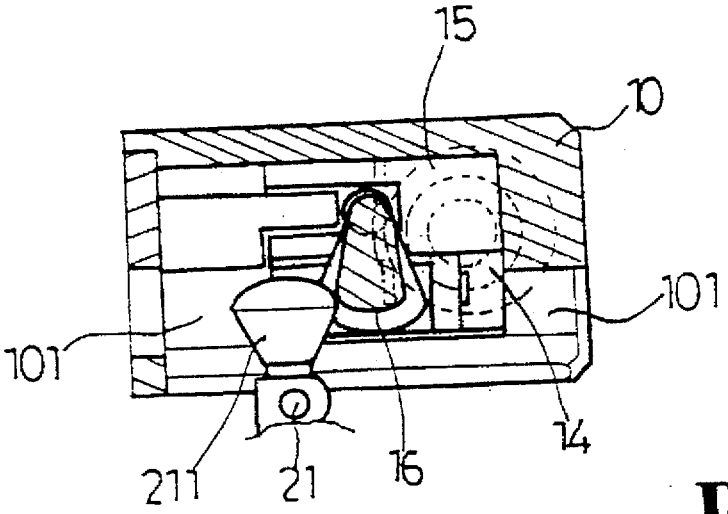
FIG. 7 is a cross-sectional view similar to FIG. 5, in which the door lock mechanism is in a locked status.
Figure 8:
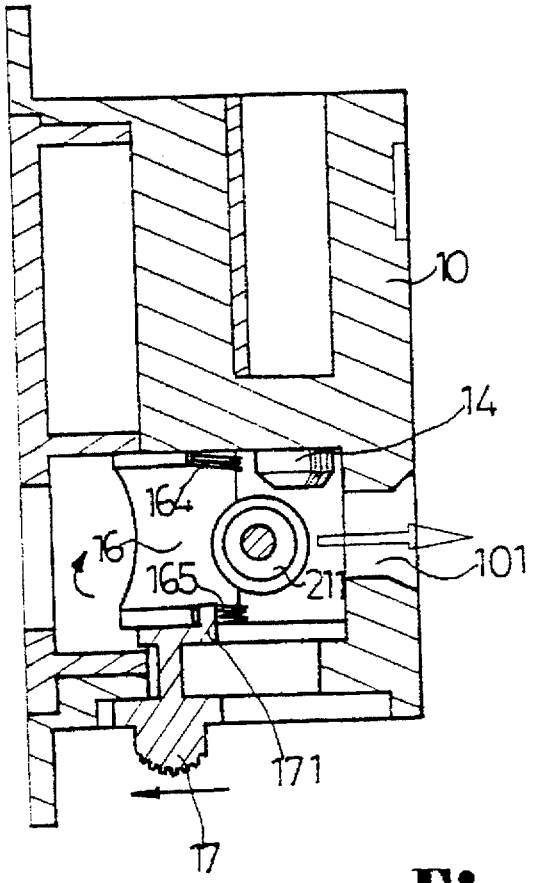
FIG. 8 is a cross-sectional view similar to FIG. 6, illustrating unlocking of the door lock mechanism by a release button.
Figure 9:
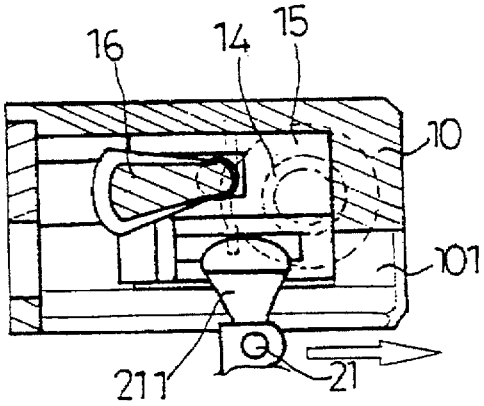
FIG. 9 is a cross-sectional view similar to FIG. 7, illustrating unlocking of the door lock mechanism by a release button.

In use, referring to FIGS. 6 and 7, the slide bolt 211, after it is inserted into the retaining slot 101 (via bearing against and passing through the operative surface 163), cannot be removed from the retaining slot 101 as the lock piece 16 is stopped by the retaining member 14 of the lock core 15. Referring to FIGS. 8 and 9, when the people inside the house wants to go out, the release button 17 may be pushed along a direction indicated by a solid arrow in FIG. 8 such that the lock piece 16 is pivoted leftwardly (see FIG. 8) and thus is disengaged from the retaining member 14, thereby allowing removal of the slide bolt 211 from the retaining slot 101. In other words, the people inside the house may go out by operating the release button 17 even if the lock core 15 is in a locked status. Accordingly, people, even without the key, may escape from the house under emergency, e.g., fire.

Figure 11:
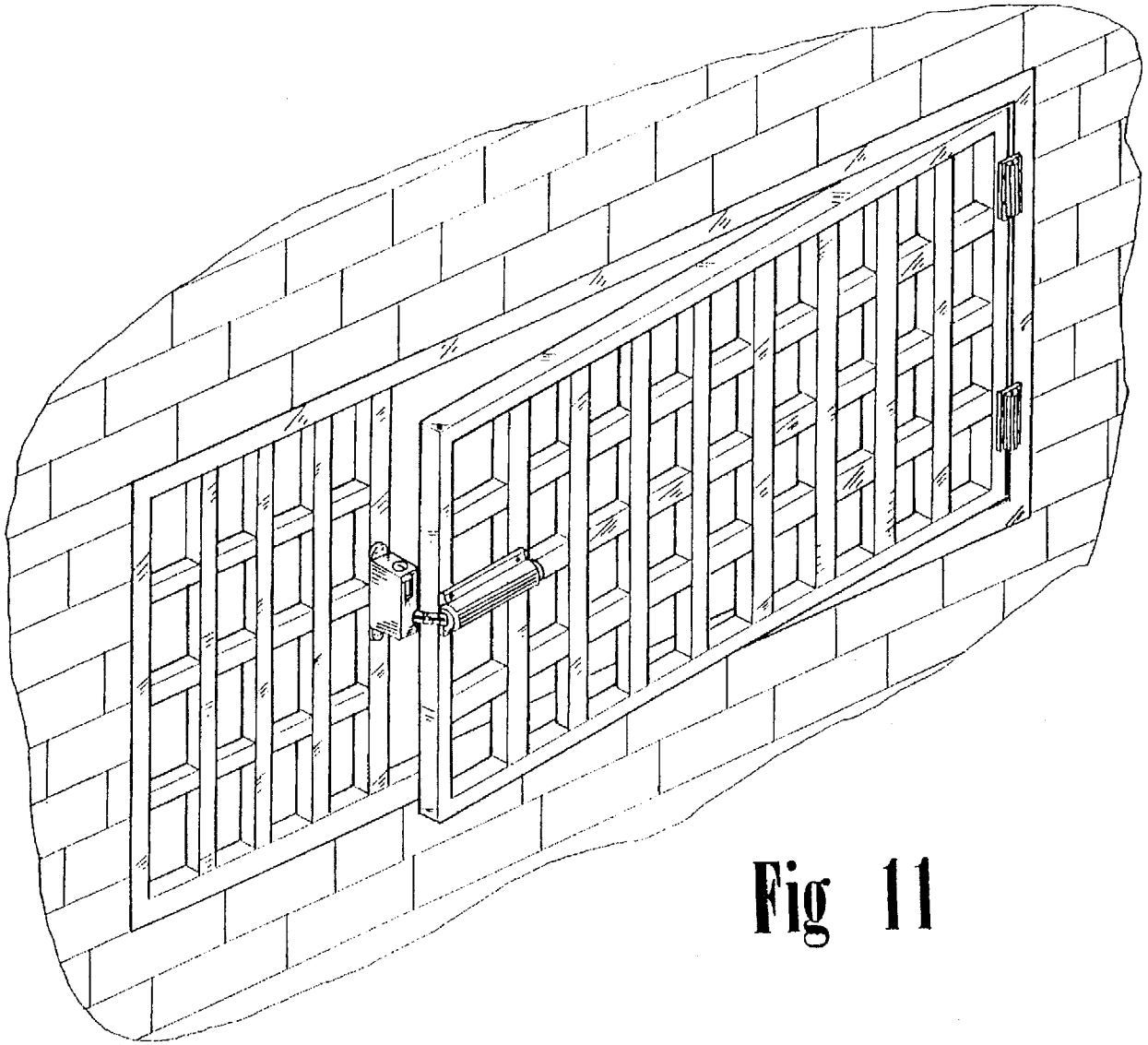
FIG. 11 is a schematic perspective view illustrating application of the door lock mechanism on a window.

Referring to FIG. 10, when the lock core 15 is in the locked status and there is nobody home, the lock mechanism may allow the door to be opened by an unauthorized person for a small gap. The slide bolt 211 is rotated through a small angle and thus engages with the lock piece 16, thereby preventing further opening of the door. Thus, the unauthorized person may think that somebody must be in the house and thus dare not break into the house. FIG. 11 illustrates a further application of the invention, in which the lock mechanism is mounted to a window.

Although the invention has been explained in relation to its preferred embodiment, it is to be understood that many other possible modifications and variations can be made without departing from the spirit and scope of the invention as hereinafter claimed.

What is claimed is:

1. A door lock mechanism, comprising:

a retainer housing assembly comprising:

a retainer housing adapted to be mounted to a doorframe and including a retaining slot defined in a lateral side thereof and a compartment defined therein, a lock core received in the compartment the lock core having a retaining member mounted to a lower end thereof, and a first elastic member mounted around the retaining member;

a lock piece pivotally received in the retaining slot and including an arcuate operative surface, the lock piece further including a first end releasably engaged with the retaining member and a second end;

a second elastic means for returning the lock piece to its initial position; and a release button having a first end releasably engaged with the second end of the lock piece and a second end for manual operation so as to be moved between a first position which engages with the lock piece and a second position which disengages from the lock piece; and a chain housing assembly comprising:

a chain housing having a longitudinal compartment defined therein;

a chain received in the longitudinal compartment of the chain housing and including a first end fixedly mounted to the chain housing and a second end which is stretchable beyond the chain housing;

a third elastic means mounted around the chain for returning the chain to its initial unstretched position; and a slide bolt securely mounted to the second end of the chain and releasably, slidably received in the retaining slot of the retainer housing;

wherein when in a locked position and when the release button is in its first position, the lock piece is stopped by the retaining member and the slide bolt is retained in the retaining slot and allows the door to be opened for a small gap, and when in a locked position and when the release button is in its second position, the lock piece is disengaged from the lock piece and thus allows removal of the slide bolt from the retaining slot without operation of the lock core.

2. The door lock mechanism according to claim 1, wherein the second end of the release button is in the form of a push button.

3. The door lock mechanism according to claim 1, wherein the lock piece includes an upper stub and a lower stub respectively formed on upper and lower ends thereof, and wherein the second elastic means including a first torsion spring mounted to the upper stub and a second torsion spring mounted to the lower stub, thereby allowing pivotal movements of the lock piece in the retaining slot.

4. The door lock mechanism according to claim 1, further comprising a washer mounted around the slide bolt to provide a distance between the retainer housing and the chain.

* * * * *